US006316047B1

(12) United States Patent
Rowe et al.

(10) Patent No.: US 6,316,047 B1
(45) Date of Patent: Nov. 13, 2001

(54) METHOD FOR APPLYING DRY POWDER REFRACTORY COATING TO SAND CORES

(75) Inventors: Melvin Lynwood Rowe, Grosse Ile; Arthur Miller Kirby, Allen Park, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 1134 days.

(21) Appl. No.: 08/488,521

(22) Filed: Jun. 9, 1995

(51) Int. Cl.[7] ..... B05D 1/24

(52) U.S. Cl. ..... 427/134; 427/185; 164/14; 164/138

(58) Field of Search ..... 427/134, 185; 164/14, 138

(56) References Cited

U.S. PATENT DOCUMENTS

| | | | |
|---|---|---|---|
| 3,305,900 | 2/1967 | Mulligan et al. | 22/192 |
| 3,520,711 | 7/1970 | Bish et al. | 427/134 |
| 3,688,832 | 9/1972 | Horton | 164/72 |
| 4,834,165 | 5/1989 | Egoshi et al. | 164/14 |
| 4,867,225 | 9/1989 | Downing | 164/369 |
| 4,921,038 | 5/1990 | Sasaki et al. | 164/516 |
| 4,934,440 | 6/1990 | Sakakibara et al. | 164/14 |
| 4,961,458 | 10/1990 | Downing | 164/369 |
| 5,372,179 * | 12/1994 | Sakakibara et al. | 164/14 |

* cited by examiner

*Primary Examiner*—Katherine A. Bareford
(74) *Attorney, Agent, or Firm*—Joseph W. Malleck

(57) ABSTRACT

A method of applying a refractory coating to densified foundry sand cores having micropores between the sand grains having the steps of: (a) mixing a dry powder refractory material (anhydrous $MmgOSiO_2$ talc) with a dry powder impacting media, the refractory material having a particle size in the range of 5–40 microns and the weight ratio between the refractory material and the impacting media; (b) fluidizing the mixture in a contained zone by introducing positive air pressure at one end of the zone and applying a negative pressure at the other end of the zone; and (c) quickly and entirely immersing the sand cores in the zone containing the fluidized mixture and substantially immediately thereafter withdrawing (without reciprocal movement) such sand cores without the need for added motion to be coated with essentially only the refractory material as impacted by the impacting media. The cores will be coated continuously with the refractory material, impacted with the micropores of the sand core.

8 Claims, 3 Drawing Sheets

METHOD FOR APPLYING DRY POWDER REFRACTORY COATING TO SAND CORES

BACKGROUND OF THE INVENTION

1. Technical Field

This invention relates generally to technology for treating and smoothing sand molding surfaces thereby produce higher quality metal castings using such molding surfaces.

2. Discussion of the Prior Art

In the making of automotive metal castings, complex internal cavities are formed by sand cores typically made of coarse sand particles to assure higher strength. If the surface pores of such cores are not coated or filled, metal will penetrate into the interstices between sand grains, causing at best an undesirable rough cast surface, and at worse, difficulty in removing the sand cores from the cast surfaces. To remedy this, a fine refractory slurry is usually applied by dipping, spraying or brushing the surfaces of the sand cores. Although the slurry smoothes the sand core surfaces, defects may occur in the metal castings as a result of cracks or blisters arising in the refractory coating when dried; moreover, the need for drying slows down the manufacturing process considerably.

Coating sand molding surfaces with a dry powder, by use of a fluidized dry powder bed, has been attempted as early as 1985 to eliminate the need for drying. In one attempt, the dry powder had a uniform particle size smaller than the pores of the sand surface. This resulted in an inadequate coating and inadequate penetration of sand pores; the dry powder lacked efficient momentum to penetrate deeply into the pores. In another attempt, the powder was formed as a mixture having a dry powder pushing material to achieve greater penetration of the treating powder. The pushing material had a slightly greater particle size, density and volume, relative to the treating powder; however, the differential was small. This necessitated reciprocal movement of the sand surface to be coated, within the fluidized bed, to reach all of the pores. The need for a period of movement slowed down the coating process and increased the risk of sand surface breakage during such movements, particularly on a repeated basis with a large number of strokes. The randomness of the controlled pushing material in the fluidized bed was not sufficient to achieve a continuous coating on the sand surfaces.

SUMMARY OF THE INVENTION

It is an object of this invention to coat sand cores in a fluidized bed by a method that eliminates the need to move or reciprocate the core within the fluidized bed, and yet produces a sound continuous coating within a few seconds after insertion of the sand core within the bed.

In particular, the invention is a method of applying a refractory coating to densified foundry sand cores having micropores between the sand grains. The method comprises (a) mixing a dry powder refractory material with a dry powder impacting media, the refractory material having a particle size in the range of 5–40 microns and the weight ratio between the refractory material and the impacting media being 1:13 to 1:22; (b) fluidizing the mixture in a contained zone by introducing positive air pressure at one end of the zone and applying a negative pressure at the other end of the zone; and (c) quickly and entirely immersing the sand cores in the zone containing the fluidized mixture and substantially immediately thereafter withdrawing such sand cores, without the need for added motion, to be coated with essentially only the refractory material as impacted by the impacting media. The cores will be coated continuously with the refractory material, impacted within the micropores of the sand core. Advantageously, the refractory material is anhydrous $MgOSiO_2$ talc, the impacting media is zircon sand, and the foundry sand core body is formed of resin bonded zircon sand.

DETAILED DESCRIPTION AND BEST MODE

Figure 1:
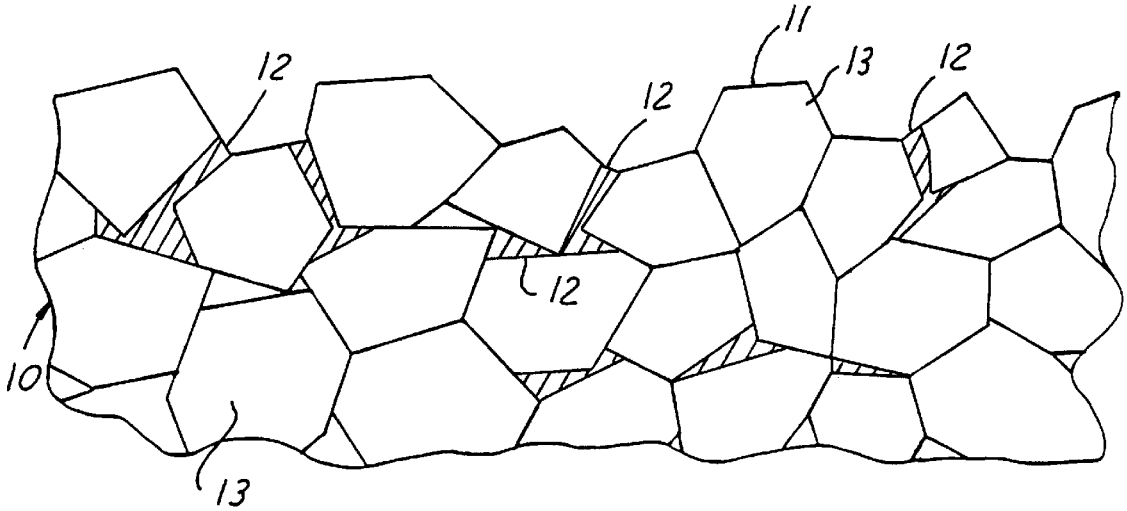
FIG. 1 is a sectional elevational view of a fluidized bed apparatus of this invention illustrating the immersion of an automotive component sand core into the bed for coating the core's exterior surface.

Foundry sand cores, used in the casting of metals for complex aluminum or ferrous metals (particularly those that are used in the automotive industries for making engine blocks or heads), utilize one of two methods for fabricating the cores. The sand cores are either made with silica sand mixed with a thermosetting synthetic resin (usually a phenolic resin) and cured in a hot box to set the resin and solidify the core as a unitary body, or the foundry sand is mixed with a cold setting resin that rigidifies by chemical curing using a gas that sets the resin. Such foundry sand core 10, as shown in FIG. 1, will have a surface roughness of 300–800 micro-inches density, and have a surface 11 which contains a number of voids or micropores 12 resulting from the arrangement of course sand grains 13 creating such surface. The micropores 12 will range in size from about 25 to about 125 microns. Coating the surfaces of a hot box thermoset core to fill the voids presents a problem because of the risk of overcoating, undercoating, or dimensional change to the shape of the core; the cost of coating must be low. Coating the surface of cores made with cold setting resin presents a problem to avoid any interaction between the resin and coating.

Figure 2:
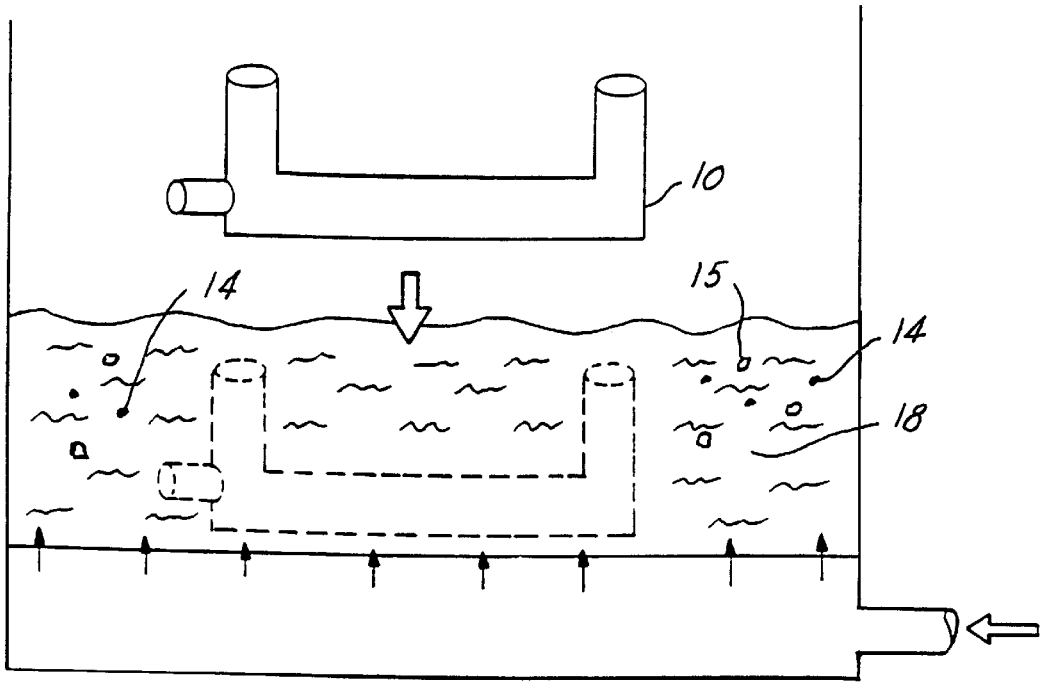
FIG. 2 is a greatly enlarged portion of the core surface of FIG. 1 that is to be coated.

As shown in FIG. 2, this invention coats and impregnates the surface region of such foundry sand cores 10, by first selecting two basic ingredients to form a dry powder coating mixture 18, namely common anhydrous talc ($MgOSiO_2$) 14 and zircon sand 15. The mixtures is fluidized by passing a gas therethrough at the right pressure, allowing the core 10 to be immersed therein and coated by the fluidized suspended mixture. The ingredients are critically proportioned in a weight ratio of 1:13 to 1:22 (talc to zircon sand), with the particle size 16 of the talc controlled to 5–40 microns. Desirably the volume ratio of the talc to zircon sand is in the range of 1:3 to 1:5 and the average particle size ratio of talc to zircon sand is 1:10 to 1:20. The actual selection of the volume ratio and average particle size ratio will be selected within such ranges based upon the surface roughness of the core 10.

Figure 3:
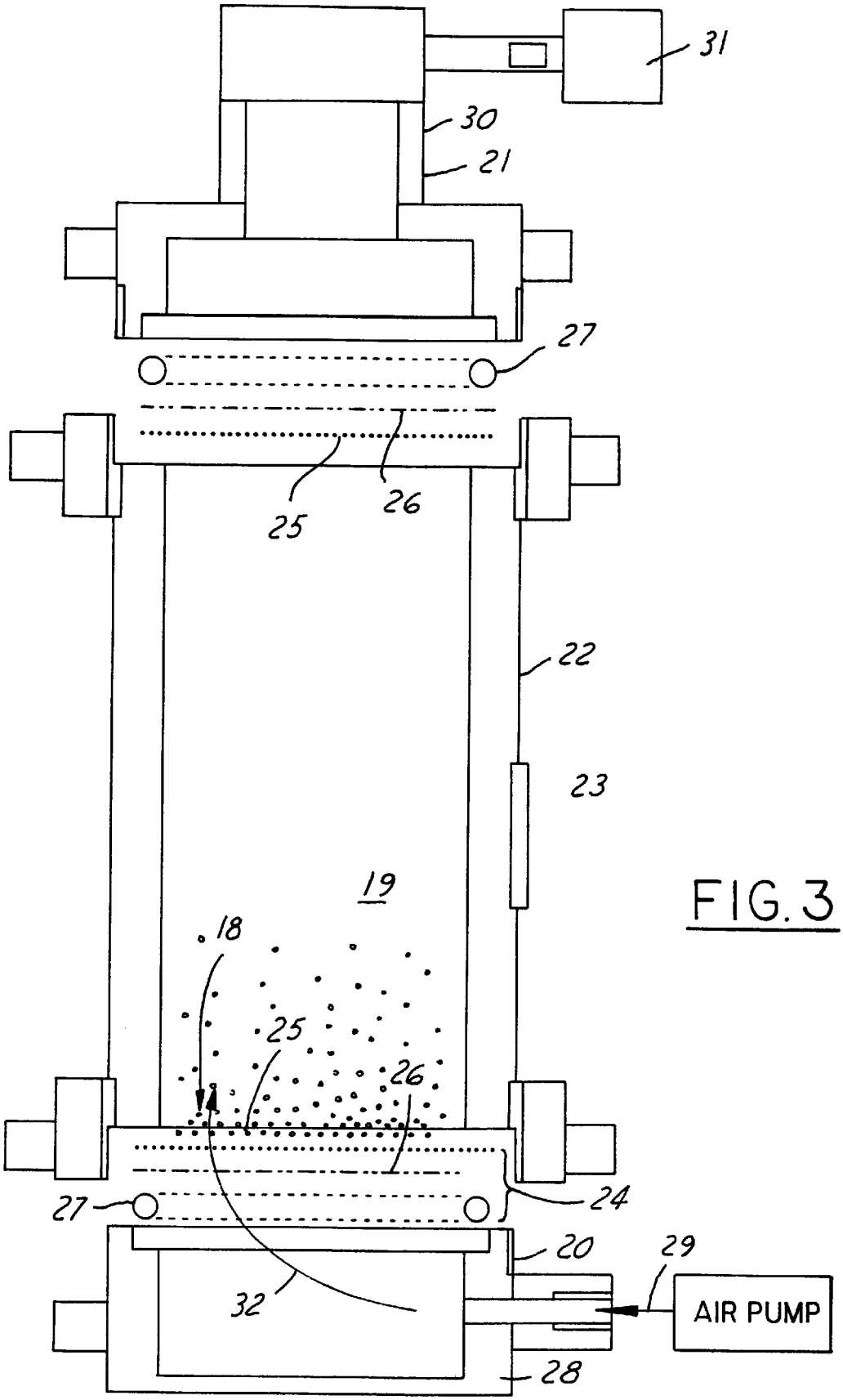
FIG. 3 is a greatly enlarged view of the same core surface as in FIG. 2 but while such surface is being treated within the fluidized bed.

As shown in FIG. 3, the mixture 18 is fluidized in a contained zone 19 by introducing a positive air pressure at one end 20 of such zone 19 and applying a negative pressure at the other end 21 of such zone. The zone 19 may be defined by a cylindrical chamber 22 having a suitable access door or opening 23 for introducing the foundry sand core to be coated. The upper and lower ends of the chamber may have a powder separation or isolation means 24 comprised of a very fine mesh screen 25 supported by another screen 26 having a much larger mesh. The screens are sealed at the ends 20 and 21 of such chamber by use of O-rings 27 maintained in compression. At the entrance to the lower end 20 of the chamber, a manifold 28 may be employed to which is connected a positive pressurized air supply 29 and at the exit or exhaust end 21 of the chamber, a connector 30 may be employed for connecting to a vacuum system 31 to complement and cooperate with the positive air pressure for moving an air flow 32 through the fluidizing zone 19. Thus, with a predetermined quantity of the powder mixture 18 deposited on the lower separation screens 25,26 and upon the introduction of such positive air supply 29, the coating mixture will be placed in controlled agitation and suspension throughout the zone. It is important that the density of the ingredients of the powder mixture be matched to the air flow supply to ensure the fluidization or controlled agitation of the powder mixture throughout the chamber.

Figure 4:
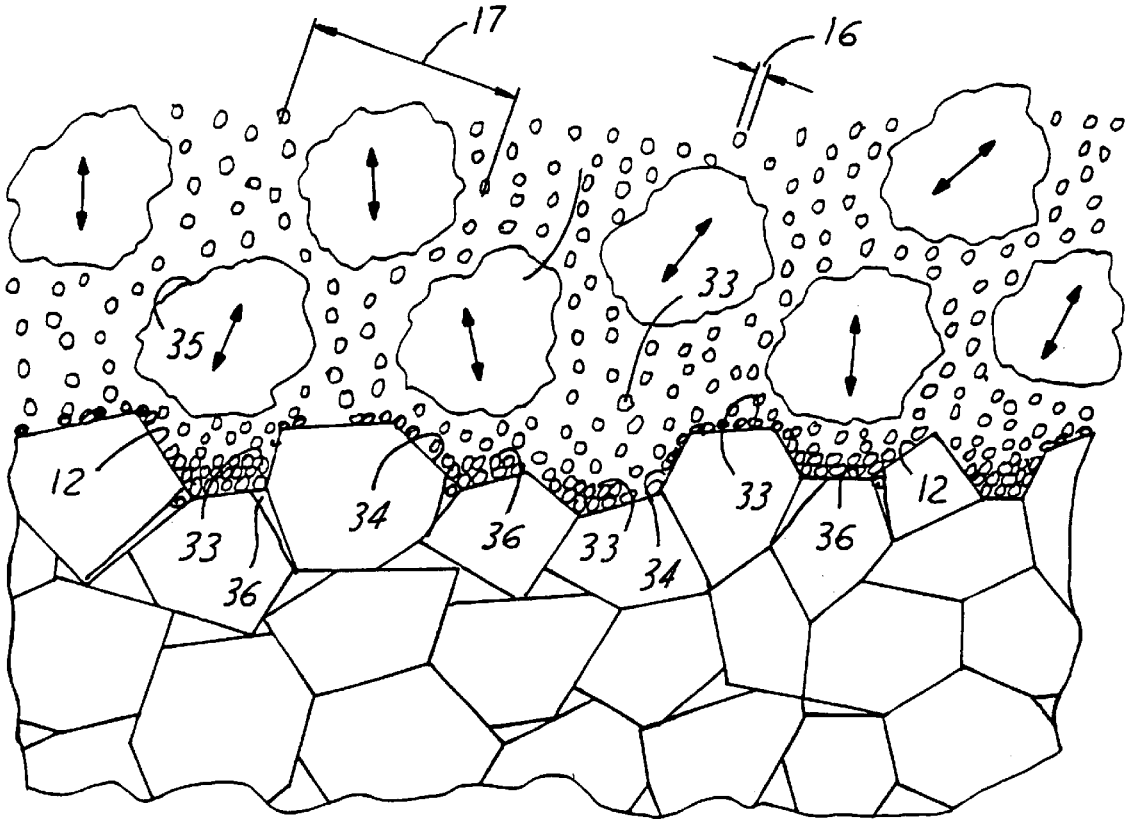
FIG. 4 is a greatly enlarged view of the core surface in FIG. 2, but showing the surface after withdrawal from the fluidized bed.

The foundry sand core 10 is introduced by quickly injecting the core into and entirely immersing it into the fluidized mixture; it is then substantially immediately withdrawn. As shown in FIG. 4, the surface of the foundry sand core, while it is present in the fluidized zone, will have talc particles 33 randomly attaching to the surface of the sand core as a result of the surface tension of sand for talc. Some of such talc 33 will begin to build up in the more exposed voids 34 of the surface based upon random collection. However, such talc 33 will not be retained in such voids or micropores because of the lightness of contact and the limited surface tension adhesion. The larger particles 35 of zircon sand each of which are greater in size than the micropores 12, will randomly impact against any such collection of talc particles on the surface or within the voids or micropores and force them into greater compaction and adhesion at 36 within or to the sand core surface.

Figure 5:
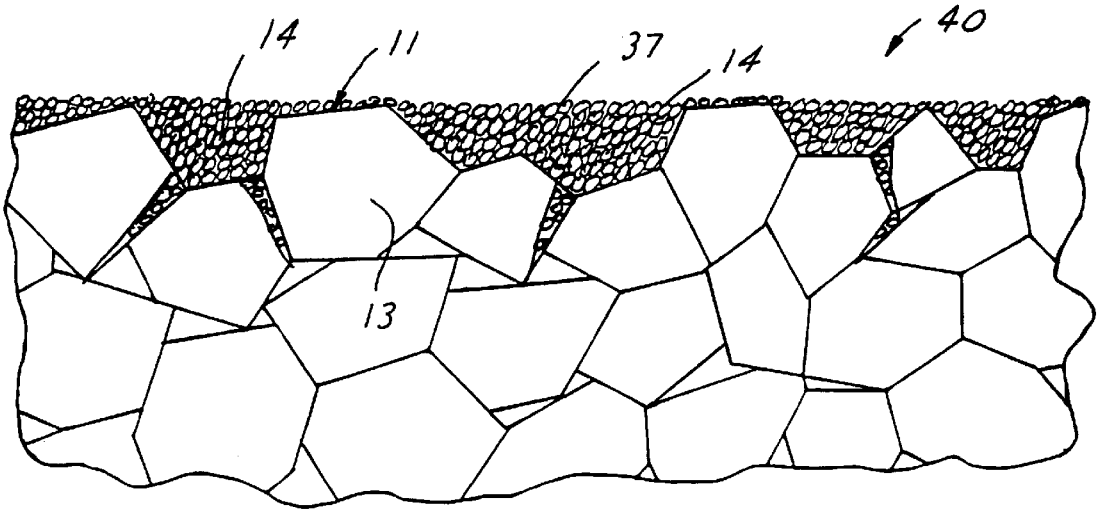
FIG. 5 is a central sectional elevational view of an apparatus for carrying out the method of this invention.

Upon withdrawal of the core from the fluidizing zone, the core surface 11 will appear with a coating 37 of densified and compacted talc 14 across substantially the entire surface 11 of the foundry core as shown in FIG. 5. Such rapid coating takes place without the need for added motion within the fluidizing chamber. The addition of a vacuum or negative pressure to the air flow 32, coupled with the special selected ratio of the densities of the talc particles 33 to the zircon sand particles 35, not only allows for the repeated impaction of the talc into the micropores as a result of the turbulent conditions, but also insures almost instantaneous coating.

In a specific example of this invention, the container 22 was filled with four buckets of clean dry zircon sand (having a weight of 300 grams) and one bucket of talc (having a weight of 47 grams); the sand and talc were introduced in alternating small additions to promote homogenization of the ingredients within the mixture. A screen analysis of the zircon sand showed that the particles ranged in size 17 from 100–300 microns with an average particle size of about 200 microns and had a density of 184.4 pounds per cubic foot or 2.95 grams per cc. The talc possessed a particle size 16 that ranged from 5–40 microns with an average particle size of 15 microns; the talc had a density of 42.11 pounds per cubic foot (0.67 grams per cc). The mixture of talc and zircon sand rendered a weight ratio in the range of 13:1 to 22:1 and a volumetric ratio of 4:1. The negative air exhaust was actuated by connection to a vacuum system 31 with a negative pressure of about 2.2 psi. The positive air pressure at the manifold inlet was slowly initiated in increments of about 0.4 psi, to gradually obtain fluidization at a stable positive pressure of about 2.9 psi. Particles of the finely powdered coating material which became airborne above the surface of the fluidized bed (above the lower screens 25,56) were collected using the vacuum and eventually were returned to the fluidized bed at a later stage to eliminate or reduce material losses during operation.

The foundry sand core 10, to be coated, was picked up at contact points where core print surfaces existed (print surfaces are those areas of the core which make core-to-core or core-to-mold location and contact during assembly; these surfaces do not result in casting surfaces and therefore do not require a coating). The foundry sand core was totally immersed in the fluidized bed 38 by gently submerging it therein either from the top or through an access door 23; all surfaces to be coated were completely below the upper surface 39 of the fluidized zone or bed 38. The core is immediately removed from the fluidized bed with little or no residence time or movement of the core required in the fluidized bed. Preferably the core upon withdrawing is gently rotated to clear off any excess talc and sand while it is still over the fluidizing bed. If it is not rotated over the bed, the core may be gently shaken to allow loose coating material to fall back into a catch. No blow off of the sand or talc is required by use of compressed air.

The coated sand core 40 is then either fitted into the sand mold assembly or transferred to a storage rack. To ensure continuous proper coating of the core surfaces the volume of the sand mixture should be checked at periodic times. The coated cores may be compared to a master desired coated core surface and if there is an indication that the core appears to be darker than the master then small quantities of the talc may be added to the fluidizing chamber, preferably using return particles that were sucked off by the vacuum system.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of applying refractory particle coating to densified foundry sand cores having micropores between sand grains, thereby comprising:

(a) mixing a dry powder refractory material with a dry powder impacting media, the refractry material having a particle size in the range of 5–40 microns and the weight ratio between said refractory material and impacting media being 1:13 to 1:22;

(b) fluidizing said mixture in a contained zone by introducing positive air pressure at one end of such zone and applying a negative pressure at the other end of such zone; and (c) entirely immersing said sand cores into said zone containing such fluidized mixture and substantially immediately thereafter withdrawing such sand cores without need for added reciprocal motion to be coated with essentially only the refractory material as impacted by said impacting media.

2. The method as in claim 1, in which said refractory material is anhydrous $MgOSiO_2$ and said impacting media is constituted of zircon sand.

3. The method as in claim 1, in which the volume ratio of said refractory material to said impacting media is 6:1 to 3:1, and the average particle size ratio of said refractory material to said impacting media is 1:10 to 1:20.

4. The method as in claim 1, in which the micropores of said foundry sand cores have a size in the range of 25–125 microns.

5. The method as in claim 1, in which the average particle size of said refractory material is in the range of 10–17 microns, and the average particle size of said impacting media is in the range of 150–220 microns.

6. The method as in claim 1, in which the airflow through said contain zone is maintained at a rate of 20 cubic feet per minute.

7. The method as in claim 1, in which the density of said refractory material is in the range of 0.5–0.7 grams per cc, and said impacting media has a density in the range of 2.7–3.05 grams per cc.

8. The method as in claim 1, in which the withdrawing of the coated sand core from said zone is immediately in the condition for use as a coated sand core without the need for pressurized air cleaning.

* * * * *